US005316065A

United States Patent [19]

Alligood

[11] Patent Number: 5,316,065

[45] Date of Patent: May 31, 1994

[54] BURGLAR AND STORM-RESISTANT COVER FOR WINDOWS AND DOORS

[76] Inventor: Ira J. Alligood, 1160 Hillsboro Mile P.H., Hillsboro Beach, Fla. 33062

[21] Appl. No.: 993,126

[22] Filed: Dec. 18, 1992

[51] Int. Cl.[5] ..... E06B 9/30

[52] U.S. Cl. ..... 160/170; 160/33; 160/34; 160/172

[58] Field of Search ..... 160/170, 172, 168.1, 160/176.1, 178.3, 131, 132, 32, 33, 34; 49/90.1

[56] References Cited

U.S. PATENT DOCUMENTS

| | | | |
|---|---|---|---|
| 969,777 | 9/1910 | Franke . | |
| 1,616,385 | 2/1927 | Metcalf | 160/176.1 X |
| 2,205,156 | 6/1940 | Rowley . | |
| 2,487,108 | 11/1949 | DeCarlo . | |
| 2,551,736 | 5/1951 | Guarcello | 160/172 X |
| 2,574,729 | 11/1951 | Coffman | 160/131 X |
| 2,577,884 | 12/1951 | Garubo | 160/172 |
| 2,687,769 | 8/1954 | Gershuny | 160/170 |
| 2,736,372 | 2/1956 | Etten | 160/131 X |
| 3,022,549 | 2/1962 | Cummings | 49/90.1 X |
| 3,350,996 | 11/1967 | Rose | 49/90.1 X |
| 3,853,169 | 12/1974 | Music et al. | 160/172 |
| 3,872,911 | 3/1975 | Janes | 49/90.1 X |
| 4,341,254 | 7/1982 | Schaller et al. | 160/172 |
| 4,799,526 | 1/1989 | Reeves . | |
| 4,967,509 | 11/1990 | Storey . | |

FOREIGN PATENT DOCUMENTS

| | | | |
|---|---|---|---|
| 94682 | 11/1897 | Fed. Rep. of Germany | 160/170 |
| 179892 | 3/1954 | Fed. Rep. of Germany | 160/170 |
| 652349 | 4/1951 | United Kingdom | 160/131 |

*Primary Examiner*—Blair M. Johnson
*Attorney, Agent, or Firm*—C. Hercus Just

[57] ABSTRACT

A burglar and storm-resistant cover for windows or doors and the like comprising a frame including an upper frame member and a pair of vertical U-shaped channels connected to the ends of the upper frame member and spaced to receive for vertical movement respectively of the opposite end portions of metallic louvers respectively having a relatively narrow and normally uppermost panel integral with a depending relatively wide vertical panel, a pair of first cables respectively adjacent opposite end portions of the louvers and having associated devices arranged to maintain the louvers in spaced relationship when extended vertically to close the window or door to view, coiling arrangements operable to contract the louvers into complete or partial compact manner, a pair of second cables respectively associated with the opposite end portions of the louvers and connected at their lower ends to end portions of the lowermost louver for elevation of the same when coiled in the upper portion of tile frame, and a pair of third vertical cables connected at spaced locations to the opposite end portions of the narrow upper panels of the louvers, whereby when said third cables are pulled downward when the louvers are in closed position, the louvers will be disposed uniformly in tilted manner to provide light-passage openings. Several types of locking means respectively maintain the louvers locked in closed position and certain types of cable coiling mechanisms are provided.

11 Claims, 4 Drawing Sheets

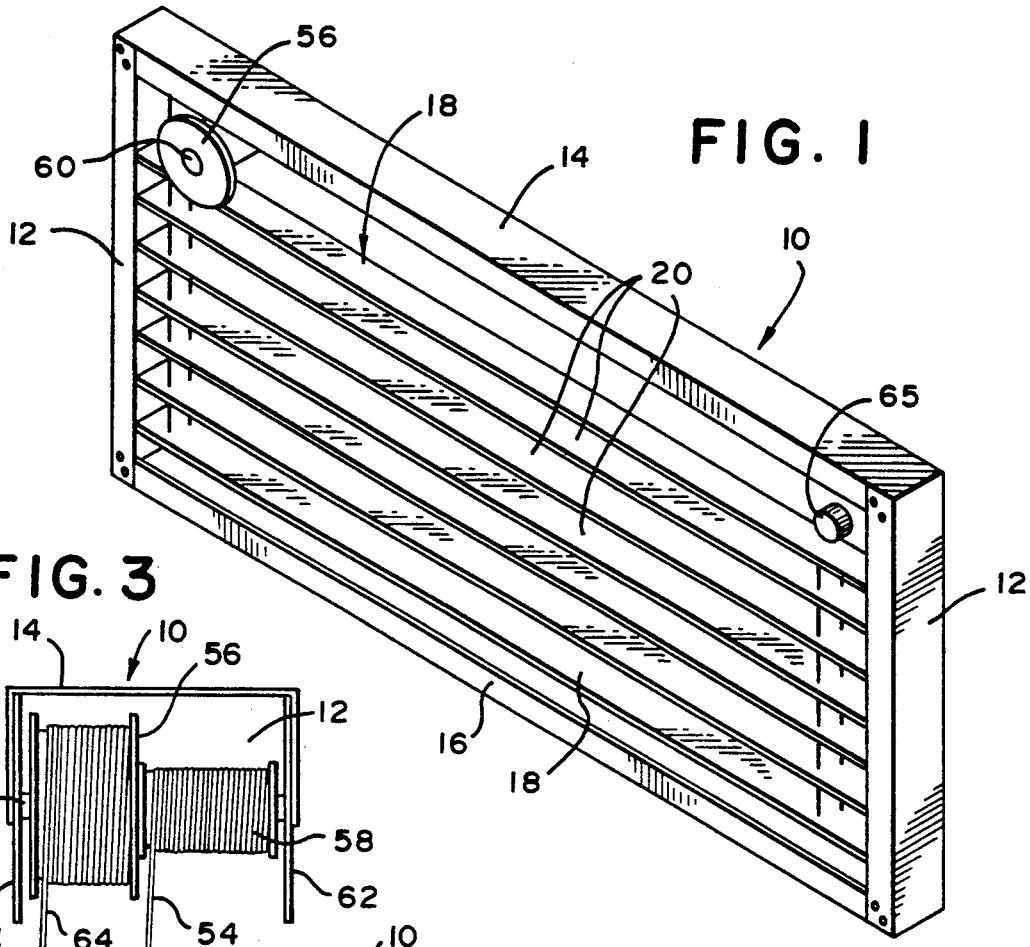
FIG. 1
FIG. 3
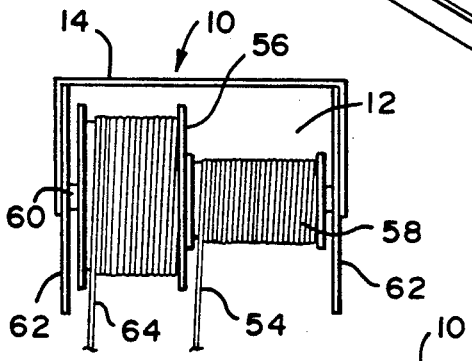
FIG. 2
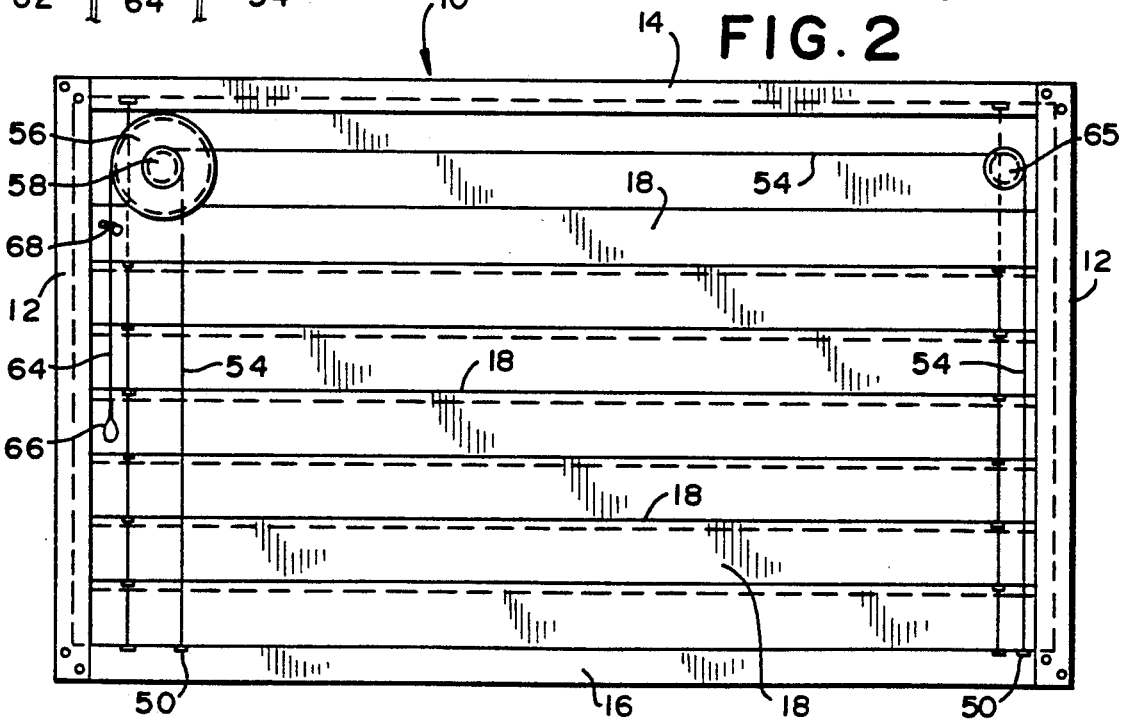

FIG. 7
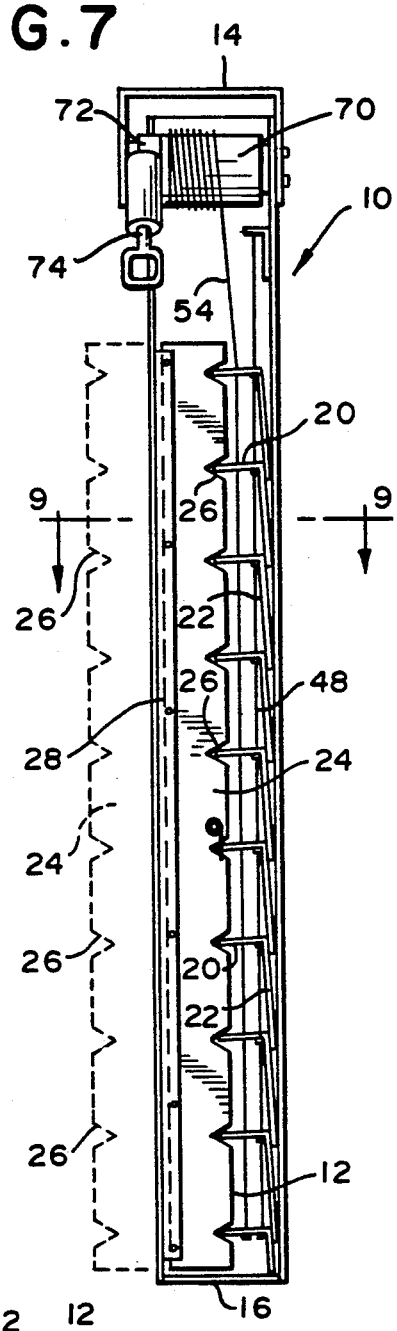
FIG. 8
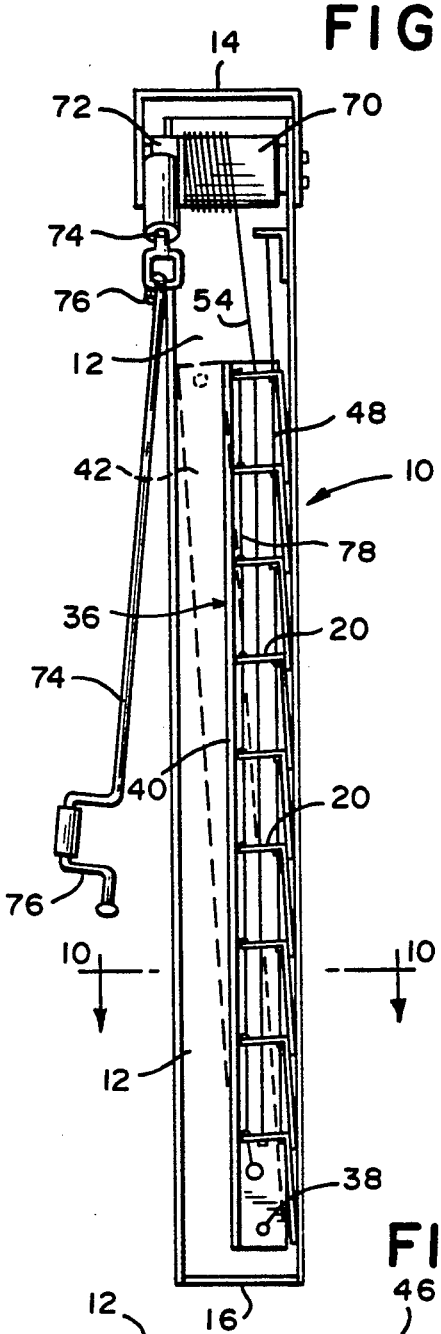
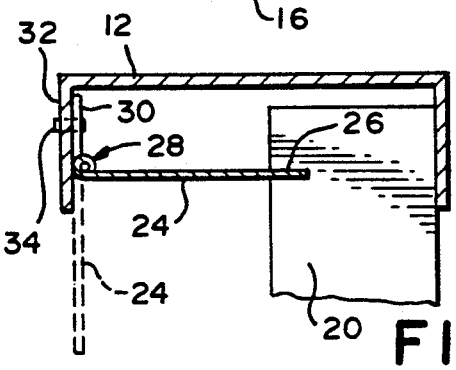
FIG. 9
FIG. 10
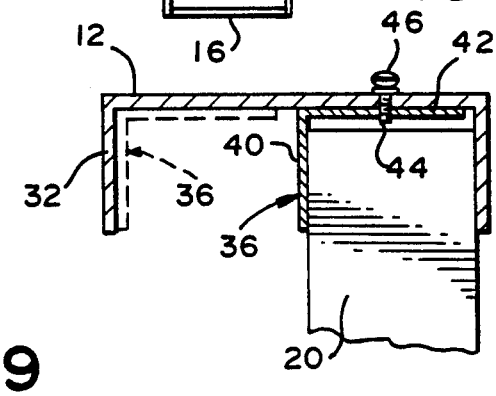

BURGLAR AND STORM-RESISTANT COVER FOR WINDOWS AND DOORS

BACKGROUND OF THE INVENTION

The breaking and entering of homes, business establishments and various types of buildings usually is found to be on the rise in times of economic stress. Burglar alarms tend to deter such activity but there are certain classes of persons who live by their wits that find successful ways of committing robberies to their advantage.

One way of attempting to discourage robberies in homes and other types of buildings is to protect windows and doors in a manner to at least discourage attempts at robbery if not actually prevent breaking and entering of buildings except where brute force is used to effect entering and robbing.

In present business establishments which have show windows, it is not uncommon at present to use various types of parallel bars loosely connected in various manners which at least tend to discourage robbery except by the hardened type of criminal individual. Such arrangements do not protect business premises from show windows being broken and articles removed therefrom through the broken glass. It is the principal purpose of the present invention to provide several types of covering arrangements for windows and doors which are intended to protect the same against damage either from robbery or storms, especially storms of severe nature, such as hurricanes.

SUMMARY OF THE INVENTION

The present invention, in its preferred embodiments, contemplates the use of louvers made from metal and which are adapted to he arranged in a manner to cover the entire areas of windows or doors and, especially those made of glass. In areas subject to severe storms and especially hurricanes, glass is very subject to severe damage, whereas if the glass is protected by complete areas of effective metal, the latter, so to speak, takes the gaff of a storm, especially when the supporting structure for the metal is adequate to resist damage to the same, as well as the glass items it covers and thereby protects.

It is the principal object of the invention to arrange louvers of storm-resistant metal in such a way that they can be constructed readily, especially from relatively light-weight metal, such as aluminum, and so design the louvers that they not only can be readily formed from aluminum but especially be formed in shapes that lend themselves to substantial strength to resist injury by storms to such shapes.

It is a further object of the invention to so design the louvers that they lend themselves to being articulated in a manner to be readily handled and manipulated and also to being stored compactly when not in covering arrangement over windows or doors.

Still another object of the invention is to provide several different means effective to lock the louvers in covering relationship over the windows and doors but wherein relatively maximum flat areas of the louvers effect the covering of the windows and doors but the bracing of the covering arrangement is simply but effectively braced against flexure by transverse integral bracing panels.

One additional object of the invention is to integrate highly effective manipulative mechanism with the louvers by which only minimum, manual effort is required to raise the assembly of louvers from depending extended covering position to a compactly stored position, preferably in the upper portion of a frame within which the louvers are supported, and the louvers also are guided vertically in guide channels between an extended covering position and a compact elevated stored position out of sight.

Another object of the invention is to support and manipulate the louvers by relatively small diameter flexible steel cables which readily can be manipulated and coiled even upon spools of relatively small diameter, the steel of the cables preferably being stainless, especially to resist rusting in sea atmospheres.

One other object of the invention is to provide a very simple yet highly effective means to support and suspend the louvers in extended covering position by the use of stop-like members of larger idameter than the cable-accommodating openings in the louvers, which are adjacent opposite ends thereof, said members being fixed to said cables in desired louver-spacing locations by crimping the members fixedly to said cables to provide positioning support for the louvers, said members being known technically as part of pop-rivets.

A further object of the invention is to employ preferably sets of three cables, each set respectively being adjacent the opposite ends of the louvers and in which a first set comprises vertical spacing means for the louvers when extended in closed position, a second set comprises elevating cables which are fixed at one end to the lowermost louver and extend upwardly to coiling means which raise the louvers from closed to open position, and a third set of cables which are connected to the narrower flanges of the louvers adjacent the outer edges thereof and by pulling downward on the lower end of said third cables, the louvers can be pivoted simultaneously in a direction and manner to cock or tilt the louvers in a manner to permit ventilation and permit at least limited light to pass through the openings between arrangements of both the narrower and relatively wider panels of said louvers.

Another object of the invention is to provide a cable-coiling device operable to coil the set of second cables to effect raising of the louvers to compact elevated position for viewing through the window or door over which the louvers are adapted to extend, said device utilizing a bevel gear unit which may be either power-operated or operated by a hand crank or power-reducing set of spools of different diameters. A worm gear unit also may be used.

A still further object of the invention is to provide for window arrangements which are at an angle to each other, such as a show window having a main front panel and a smaller or narrower window at one or both ends of the main panel, a louver cover for the main and one or more end windows, wherein the louvers each have a narrower upper horizontal panel and a longer vertical panel to cover the central or main window and one or more end sections of the same type of louver affixed integrally to one or both opposite ends of the main section at the same angle as that of the window assembly, and utilize a plurality of sets of first and second cables respectively at the ends of the louvers and at the angles at which the main and end sections of the windows are connected, there preferably being one power means to operate coiling means for the cables and pulleys at the angles of the sections through which the cables extend and are connected to the louvers at the angular connections of the louvers.

BRIEF DESCRIPTION OF THE DRAWINGS

Details of the foregoing objects and of the invention are set forth below and are illustrated in the accompanying drawings in which:

FIG. 1 is a perspective view of a cover assembly for a window or door embodying one type of louver-raising mechanism of the invention.

FIG. 2 is a front face view of the embodiment of cover assembly shown in FIG. 1.

FIG. 3 is a fragmentary elevation of the louver-raising unit used in the cover assembly shown in FIGS. 1 and 2.

FIG. 7 is a view of the cover assembly similar to that shown 4 and further illustrating one embodiment of louver-locking arrangement.

FIG. 8 is a view similar to that of FIG. 7 but allowing a further embodiment of louver-locking arrangement illustrated in locking position in full lines and in unlocked position in phantom, this figure also illustrating a further embodiment of manually-operated louver-raising and lowering unit.

FIG. 9 is a fragmentary sectional view of FIG. 7 but on a larger scale, and showing the alternate locked position of the locking member in full lines and the unlocked position being shown in phantom, as seen on the line 9—9 of FIG. 7.

FIG. 10 is a fragmentary sectional view of FIG. 8, on a larger scale, and showing the alternate locked position of the locking member in full lines and the unlocked position being shown in phantom, as seen on the line 10—10 of FIG. 8.

DETAILED DESCRIPTION OF THE PREFERRED EMBODIMENTS OF THE INVENTION

Figure 5:
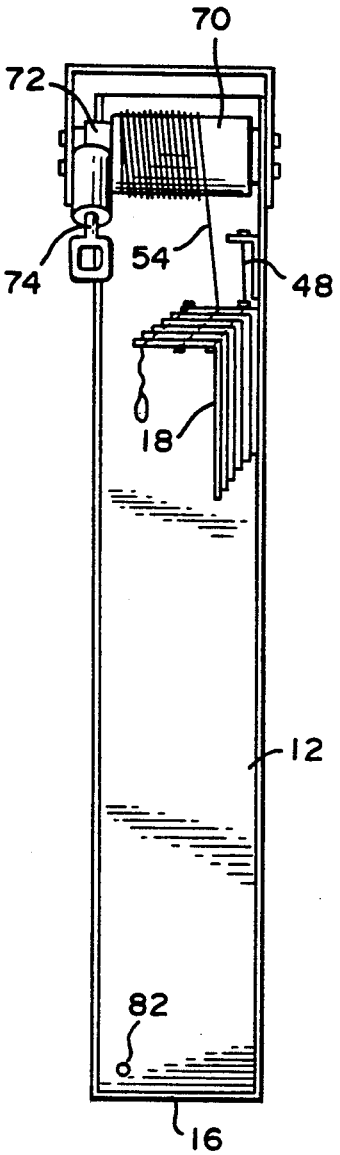
FIG. 5 is a vertical elevation similar to FIG. 4, but with less detail, and showing the louvers in exemplary elevated position for clear viewing through the frame of the assembly.

Referring to the drawings and especjally FIGS. 1 and 2, there is illustrated therein a cover 10 which is intended to be manufactured in whatever sizes of windows and doors it is proposed to cover to prevent damage to glass elements, such as windows and doors, especially on occasions of storms, hurricanes and the like. The frame 10 comprises a pair of transversely-spaced channels 12 which, for strength, preferably are manufactured from, steel or aluminum and the channels have parallel sides, the upper ends of which are secured by rivets or otherwise to the top frame member 14, which also preferably is a channel. Extending between the lower ends of the channels 12 is a bottom channel 16, the opposite ends of which are connected to the lower ends of the channels 12 by rivets or otherwise.

Figure 15:
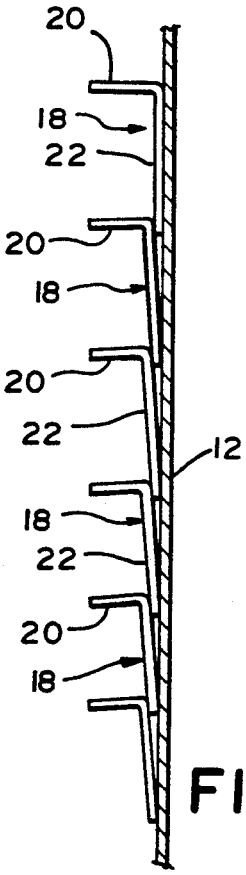
FIG. 15 is a fragmentary illustration of the relationship of the louvers when in suspended closed position within the guide channels therefor in the frame of the cover.

Shown in the upper portions of the cover 10 in FIGS. 1 and 2 is one embodiment of mechanism by which the louvers 18 are raised and lowered. The louvers 18, in end view, are best illustrated in FIGS. 4, 6, 7, 8 and 15. In FIG. 15, the louvers are illustrated in their closed position with respect to the channels 12 and in which position the louvers are held by locking means described hereinafter.

In FIG. 15, it will be seen that there is a sufficient, lower portion of the vertical flange 22 of each louver which extends downward beyond and is engaged by the horizontal flange 20 of the next lower louver.

Referring to FIGS. 7 and 9, one embodiment of locking means is shown in the form of an elongated plate or strip 24 which is provided with a series of evenly-spaced notches 26, the spacing corresponding to the vertical spacing of the horizontal flanges 20 of louvers 18. The locking member strip 24 is part of an elongated hinge 28, similar to a piano hinge. If desired, instead of a unitary hinge, it may be formed of aligned sections. Referring to FIG. 9, the pivoted elongated member 24 is shown in cross-section in engagement with a fragmentary portion of one of the horizontal panels 20 of a louver 18, and in said view, the member 24 is shown in phantom in inoperative position. The locking member 24 includes a hinge leaf 30, which, as shown in FIG. 9, is secured to a flange 32 of one of the vertical channels 12 of the cover assembly 10. Any suitable securing means, such as rivets 34, may be used.

Referring now to FIGS. 8 and 10, a different embodiment of locking means is shown in the form of an elongated locking angle member 36, which is connected at its lower end by a stud member 38 which is fixed to channel 12 and is received in short slot 39 in locking angle 36, whereby the member 38 may be moved easily to the exemplary phantom position shown in FIG. 8 to release the louvers 20 from the locked position shown in full lines in FIG. 8. The stud members 38, respectively in the lower portions of each channel 12, receive short vertical slots 39 in the locking angle members 36 to hold the lower ends of members 36 in locked position. The upper ends of members 36 are secured in locking position against the louvers by short locking pins or removable bolts 44 which are received in holes 45 formed in the vertical channels 12, as best seen in FIG. 10. The angle members 36 are removed when the louvers are to be disposed, as shown in FIG. 6.

In FIG. 8, it will be seen that the angle member 36 is a right-angled member comprising a locking flange 40, best shown in FIG. 10, and an additional integral flange 42 at a right-angle thereto and serving to brace flange 40. There are means to secure the locking member 36 in locked position, as shown in full lines in FIG. 10, one simple means comprising a pin 44, shown in FIG. 10, which extends through holes in channel 12 and flange 42, the same having a manipulating knob 46 on the outer end thereof. Any other suitable means for securing the angle member 36 in locked position may be employed.

LOUVER SUSPENDING AND OPERATING MECHANISM

Figure 4:
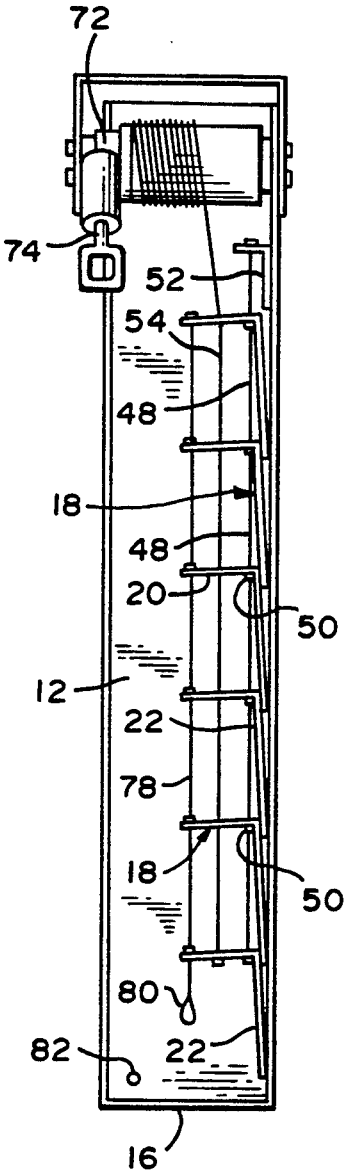
FIG. 4 is a vertical elevation of the cover assembly shown in FIGS. 1–3 with one end member of the frame omitted for viewing the inner details and illustrating the louvers in closed position.
Figure 6:
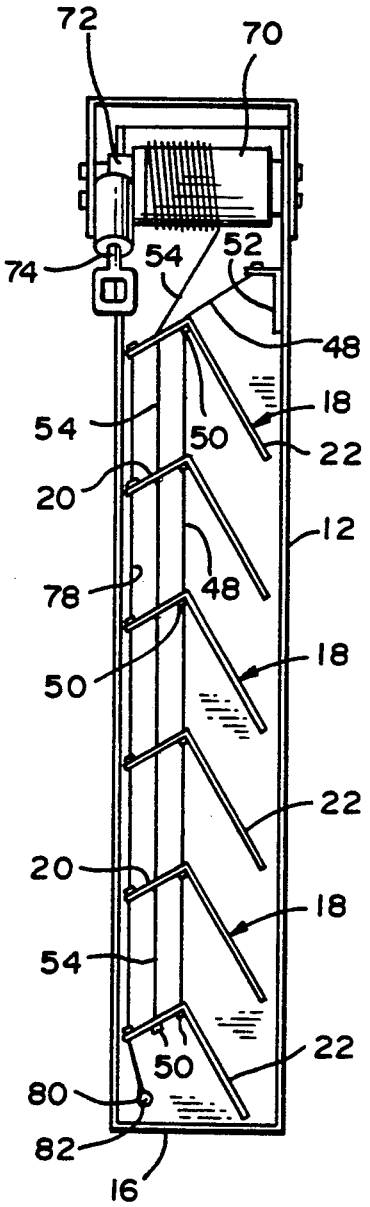
FIG. 6 is a view similar to FIGS. 4 and 5 but showing the assembly with the louvers in ventilating, as well as light-transmitting position and as the louvers are supported in spaced manner by one set of cables and are held in the light-transmitting position by another set of cables.
Figure 12:
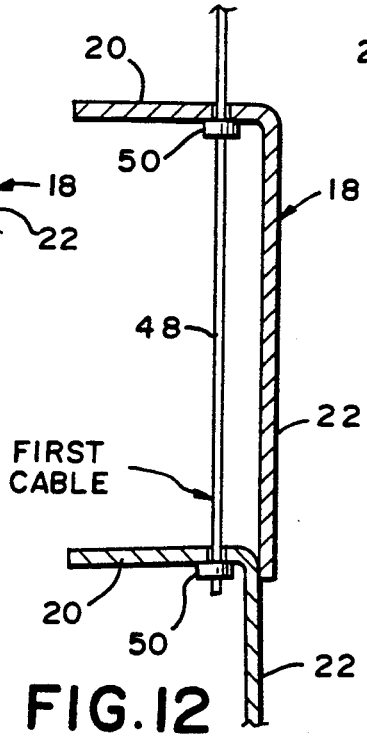
Figure 13:
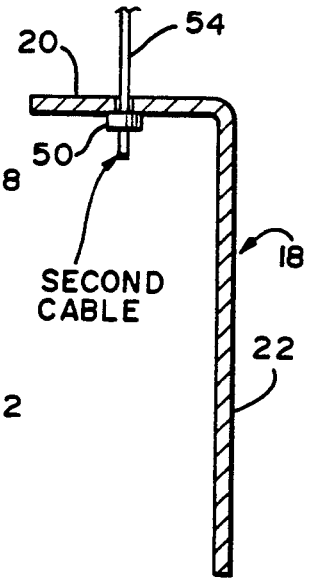

Referring particularly to FIGS. 4–6, the louver-positioning and actuating mechanism of the invention is disclosed for purposes of disposing the louvers in various selected positions. Referring particularly to FIGS. 4–6, 7 and 8, as well as FIGS. 12–14, there are a pair of first cables 48, which preferably are formed from stainless steel and of adequate strength to support an entire compliment of louvers, there being one such cable respectively adjacent opposite end portions of the louvers and extending through apertures or openings in said ends of each louver and through which the first cables 48 extend. As will be seen from FIG. 12 especially, there are affixed to first cables 48 stop-like members 50 which conveniently may comprise the body of what is known as a mechanical pop-rivet. These are affixed to the cable firmly by being crimped against the cable and are fully capable of supporting the louvers 18 in desired spaced relationship and especially in one in which a limited portion of the lower edge of the vertical panel 22 of each louver overlaps the upper portion of the next lower louver for purposes to be described, and as illustrated especially in FIG. 15. The upper end of each first cable 48 is secured to a bracket 52 affixed to one of the side flanges of a vertical channel 12, as clearly shown in FIGS. 4 and 6. When, for example, louvers are moved to window-covering position, from the compact arrangement illustrated in FIG. 5, the first cables 48 and the members 50 secured thereto will automatically dispose the louvers in successive spaced relationship from top to bottom as the louvers are lowered by operation of the second cables 54, which respectively extend through small openings formed in the horizontal flanges 20 of each louver 18 adjacent the opposite ends thereof, and the lower end of the second cables 54, as shown in FIG. 13, project through the lowermost louver 18 and another stop-like member 50 is crimped unto the lower end portion of the second cable 54, as shown in FIG. 13. The opposite ends of the second cables 54 extend upwardly to coiling means of which several embodiments are shown and described hereinafter.

CABLE-COILING MECHANISMS

Referring to FIG. 1–3, one embodiment of cable-coiling mechanism is shown in the form of a pair of spools 56 and 58 respectively of relatively large and small diameters and affixed for unitary rotation around a suitable shaft 60 which extends commonly through both spools supported in bearings in parallel vertical upper plates 62, see FIG. 3, which extend from the parallel flanges of the frame member 14, as shown in FIG. 3, but omitted in the other two figures for purposes of clarity of vision of the spools. Coiled around the larger spool 56 is a hand-operated flexible cable 64, of any suitable material and having a hand-engagable knob 66 on the lower end thereof, as shown on the left-side of FIG. 2. Coiled around the small diameter spool 58 is one of the second cables 54 which extends through corresponding openings in all of the louvers adjacent the left-hand end thereof, as viewed in FIG. 2. And secured to the lower end portion of the is cable 54 is one of the stop-like members 50 which engages only the under surface of the lowermost louver 13. For purposes of cooperating with the aforementioned second cable 54 is another second cable 54 which extends horizontally from the small diameter spool 58 toward the right, as viewed in FIG. 2, extending partially around an idler pulley 65 and extending downwardly through aligned openings in the right-hand end portions of all of the louvers 18, terminating in the lowermost louver 13 with a stop-like member 50 secured thereto and engaging the lower surface of said lowermost louver. When, for example, the cord 64 has been pulled manually downward sufficiently to elevate the louvers, to the upper assembled relationship, as illustrated in FIG. 5, it will be seen that in FIG. 2, there is shown a cable-snubbing unit 68 in the upper left-hand corner thereof which unit functions similarly to a conventional one-way clutch cord lock, which engages the pull cord 64 in a manner to prevent reverse movement thereof until the snubbing unit is released, such as when the louvers are to be lowered.

Referring to FIGS. 4–8, it will be seen that the second cables 54 may be operated by power mechanism being in the form of rotatable spools 70 which are mounted between the opposite flanges of the top frame member 14 in suitable bearings and powered by a bevel gear unit 72 of conventional type and operated by a rotatable shaft 74 that has a loop on the outer end thereof for selective connection to either a battery-operated portable motor, not shown, having a hook, not shown, engagable in the loop, shown on the shaft 74 and adapted for retation in a direction to coil one of the second cables 54 around the spool 70 and a second spool, not shown, may be mounted similarly to the idler Dully 65, shown in FIG. 2, which could be mounted in the opposite end of the top frame member 14 around which the other cable 64 extends downwardly to the lowermost louver 18. Referring to FIG. 8, and also in the type of manually-operable crank unit 74 as shown, has a hook 76 at the upper end thereof for engagement with the loop on the shaft 74 of the bevel gear unit 72 with the handle 76 of the crank unit 74 may be rotated to effect rotation of the spool 70 and thereby elevate all of the louvers to the raised, compact position illustrated in exemplary manner in FIG. 5.

Figure 14:
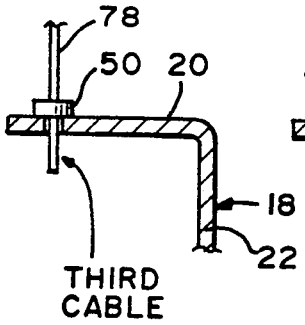
FIGS. 12–14 are fragmentary disclosures, on a larger scale than elsewhere, of the three different cables and illustrating clinched members respectively engaging the surfaces of louvers in a manner to cause them to function respectively in the respective intentions for them.

When, for example, it may be desired to dispose the louvers 18 in tilted position, such as shown in exemplary manner in FIG. 6, either for purposes of ventilation or for admitting a limited amount of light through the louver assembly, the present invention includes a pair of third cables 78 which are shown in exemplary manner respectively in FIGS. 4, 6 and 8, said cables extending respectively through aligned openings in the upper horizontal panels of each louver 18 adjacent the outer edge thereof and including stop-like members 50, see FIG. 14, said stop-like members being spaced on the cables 78 at equal distances corresponding to the spacing of the members 50 on cables 48, for example. The cables 78 extend from the uppermost louver 18 to and through the lowermost louver 18 and terminate in suitable means, such as an exemplary loop which may extend around a holding pin 82, or other equivalent means, after the third cables 78 have been pulled downwardly, such as by manual force, and in view of the cables engaging the outer edge portions of the narrower upper horizontal panels of the louvers 18, said louvers, in effect, will be caused to pivot around the members 50 on the first cables 48 and thereby tilt the louvers to the exemplary position shown in FIG. 6, thereby permitting ventilation through the cover 10 or the admission of at least limited light through said cover.

Figure 11:
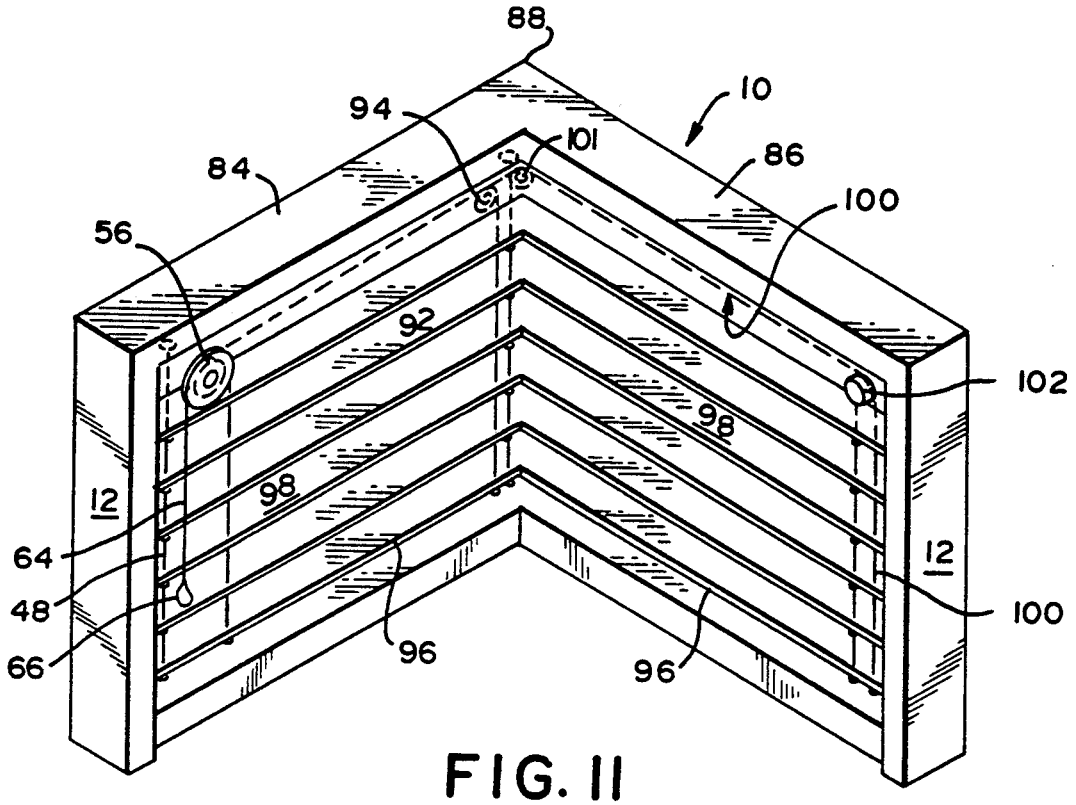
FIG. 11 is a perspective view of the cover assembly adapted to an angular arrangement of sections of the cover assembly, similar to that shown especially in FIGS. 1 and 2, and having louvers in which only the wide vertical panels are employed with narrower integral horizontal upper panels, and adequate elevating and lowering cable-operating mechanism is embodied in the construction.

It also is conceivable that in relation to windows, such as so-called bay-windows, wherein there is a principal front panel and angularly-related side panels connected to opposite ends of the front panel, covers for this type of window assembly could be desirable and possible. Accordingly, at least one version of angularly-related louvers appears to be feasible. In FIG. 11, it will been that the cover 10 comprises two angularly-related sections 84 and 86, integral with each other, and said sections extending in opposite directions of an angle 88. For example, a cable-coiling spool 56 is mounted adjacent one end of one of the sections of the cover and a cable 92 is coiled around the spool and extends horizontally to an idler pulley 94 and depends therefrom to the lowermost louver 96 and, for example, a stop-like member similar to member 50 in corresponding figures may be crimped to the lower end of the cable. Said cable will elevate the angular region of each of the angular louvers 98. Additional cable 100 is coiled at one end around a spool 56 and extends around the idler pulley 101 and second idler pulley 102 and then depends therefrom to the lowermost louver 96 and engages the same by means of another stop-like member 50 crimped thereto. Hence, it will be seen that by rotating the spool 56 in a direction to raise the louvers, the three critical points of each of the angular louvers are elevated simultaneously by the spool 90 and will uniformly elevate all of the similar angularly-related louvers in which the substantially vertical and depending panels correspond to the panels 20 in the type of louvers formed and illustrated in the preceding figure, while the substantially horizontal narrower panels comprise the upper member of each louver.

It will be understood that the coiling mechanism of the invention in the upper portion of the main frame is hidden from exterior view by the exemplary removable cover plates 62, shown in FIG. 3, but have been omitted in most of the other views for purposes of disclosure of structural details.

From the foregoing, it will be seen that the present invention provides strong, durable metallic covering louvers arranged in partially overlapping manner of vertical panels thereof, when extending in covering manner with respect to a window or door, will protect particularly glass panes and the windows or doors against storm conditions and, to a large extent, will at least deter and discourage burglary attempts. The louvers, being formed from steel panels, or sheet aluminum for lightness of weight, also have narrower, normally horizontal and integral panels at a right-angle to the longer vertical panels to afford substantial resistance to flexing in storm conditions. Particularly, due to the pressing of the vertical flanges of the louvers firmly against one flange of the vertical end channels of the overall frame, selectively by several varieties of locking mechanism, highly effective protection of such windows and doors against storms and burglary is provided by the structure of the invention.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

I claim:

1. A burglar and wind-resistant cover assembly for attachment to the frames of an opening said cover assembly comprising:

a frame having a pair of opposed transversely-spaced generally parallel U-shaped guide channels facing each other;

a top frame member extending between and connected to the upper ends of said generally parallel channels;

a series of angled louvers parallel to said top frame member and having ends located to move within said U-shaped channels wherein each of the louvers includes a first leg disposed closer to said top frame member and in a generally parallel plane with respect to said top frame member and a second leg disposed generally at a right angle with respect to said first leg, a first cable having means fixed thereto and engaging said louvers in a manner to hold them spaced at regular intervals slightly less than the dimension of said second leg of said louvers, whereby when said louvers are disposed in a spaced hanging manner from said top frame member, a lower free edge portion of each of said second legs overlaps a portion of the next louver immediately below the same; and;

at least one locking member coupled to said frame, extending parallel to said U-shaped channels and movable relative to a free edge of said first legs of said louvers in a manner to engage said edge of said first legs of said louvers to lock the louvers in a fixed position such that said second legs of said louvers overlap to form a contiguous surface which covers an openings.

2. The cover assembly according to claim 1 in which said at least one locking member comprises a pair of elongated locking members respectively hingedly-connected to an outer edge of one of opposed parallel sides of said U-shaped guide channels and an outer edge of each locking member having a row of notches spaced longitudinally in accordance with the spaces between said louvers when extended in closed position and said notches being adapted to receive the outer free edges of the first leg of said louvers when said locking members are positioned transversely to said louvers and thereby hold said second leg flatly against one inner surface of said parallel sides of said U-shaped guide channels to secure said louvers firmly in closed position.

3. The cover assembly according to claim 1 in which said at least one locking members comprises a pair of elongated angle members each respectively having a slot in the lower end thereof which receives a pin in the bottom flange of the U-shaped channel of the frame and a securing pin extending through a hole in each angle member adjacent the upper end thereof to secure said angle members in locked position, said angle members each having one flange adapted to abut firmly against the outer edges of the first legs of said louvers in a manner to hold the ends of the second legs of said louvers firmly and flatly against one inner surface of opposed parallel sides of said U-shaped channels.

4. The cover assembly according to claim 1 wherein a pair of second flexible cables are connected at one end to the lowermost louver and a rotatable spool-like means is connected respectively to said second cables in a manner to elevate the lower louver, thereby causing it to raise all of said louvers in a composite nested manner adjacent said top frame member when said spool-like means is rotated in one direction to effect such nestled arrangement of said panels.

5. The cover assembly according to claim 4 further characterized by said rotatable spool-like means comprising a relatively large diameter spool coaxial with and connected to a relatively small diameter spool, a manually-operable cord coiled around said large diameter spool and adapted to be pulled to rotate said spool in one direction to coil one of said second cables about said small diameter spool in a direction to extend down to one end said lower most louver, and another of said second cables being coiled around said small diameter spool and then extending along said top frame member and partially around a freely rotatable pulley in said top frame member and spaced from said small diameter spool and connected at its end to the opposite end of said lowermost louver, whereby when said large diameter spool is rotated as stated, said spool for said second cables with be rotated and card said second cables in a direction to raise said lowermost louver and successively dispose all of said louvers in closely stacked arrangement to expose the as desired.

6. The cover assembly according to claim 1 further characterized by said louvers being formed from suitable gage metal sheeting bent into a substantially right-angle in cross-section and said cables in the assembly being formed from steel strands and of suitable pull strength to effect assembling said louvers in stacked position at any desired vertical position.

7. The cover assembly according to claim 6 in which said means to hold said louvers spaced comprises openings in the end portions of said louvers through which said first cable extend and said cable having affixed thereto, in desired spaced locations as described, stop-like members fixed in said spaced manner to said cables in a manner respectively to abut said louvers and hold the same in the same vertical position as said stop-like members.

8. The cover assembly according to claim 4 further including a pair of third cables respectively extending vertically adjacent the opposite end portions of said louvers and extending along opposite end portions of said louvers and suitably engaging the upper surfaces of said first legs of said louvers and said third cables having lower ends engageable selectively with latching means, whereby when the lower ends of said third cables are moved downwardly while said first cables are stationary, said louvers simultaneously will be tilted uniformly in a manner to effect spaces of limited width between said louvers for the passage of light and air.

9. The cover assembly according to claim 4 further including operating means associated with said rotatable spool-like means and including a unitary bevel gear assembly unit including an operating member connected to one gear in said unit and selectively operable manually or by power to operate said spool-like means to raise said louvers into compact stacked relationship relative to said window or door.

10. A burglar and storm-resistant cover assembly for vertically positioned openings disposed adjacent each other and at an angle to each other, said cover assembly comprising a frame having vertical channel members connected at opposite ends by top and bottom frame horizontal angled members each angled at an angle corresponding to the angle between the openings to be covered by said cover assembly, said frame supporting and containing a plurality of similar shaped louvers in a vertical spaced relationship and each louver having vertical panels disposed at the angle of said top and bottom frame members and each louver also having a horizontal panel integral with the vertical panels to provide resistance to flexing thereof, a coiling spool mounted rotatably in an upper portion of one end of said frame, and a plurality of cables extending vertically respectively at opposite ends and at the angle of said louvers, at least three of said cables being spacers cables having a stop-like members fixed thereto at regularly-spaced intervals and engaging respectively under surfaces of said louvers when said louvers are in an extended vertically spaced position to dispose the vertical panels of said louvers in a slightly overlapping manner to provide an overall cover arrangement for said opening when said cover is mounted adjacent the outer surface of such opening, and said frame having idler-type guide pulleys in the upper portion of said frame respectively at the angle and at the opposite end of the frame from that in which said coiling spool is mounted, and at least three operative cables, one of said operating cables extending downwardly from said coiling spool, a second operating cable extending from said coiling spool and around an idler pulley at said angle of the frame and then downwardly to the lowermost louver, and a third operating cable extending from said coiling spool to and around an idler pulley operable in a horizontal plane at said angle and along said frame opposite that from where said coiling spool is mounted and extending around still another idler pulley at said other end of the frame and then extending downwardly to the lowermost louver and connected thereto, whereby when said coiling spool is rotated in one direction said plurality of louvers will simultaneously be raised from an extended covering position to an elevated storage position to establish said opening in visible condition.

11. The cover assembly according to claim 10 further including a second set of three cables extending through vertically aligned openings adjacent the opposite end portions of said louvers and at said angle thereof, and the terminal ends of said cables each having a stop-like member affixed thereto below the lowermost louver, whereby when said coiling spool is rotated in retraction direction, said second set of cables will be coiled to elevate said louvers simultaneously and thereby raise all of said louvers into desired compact storage manner to expose said opening with which said cover is mounted.

* * * * *